US007831351B1

(12) United States Patent
Hofer et al.

(10) Patent No.: US 7,831,351 B1
(45) Date of Patent: Nov. 9, 2010

(54) MAPPING CONTROL INPUTS TO VEHICLE-SPECIFIC CONTROL OUTPUTS AT A RECEIVER

(75) Inventors: Richard A. Hofer, Gardner, KS (US); Jonathan R. Feldkamp, Gardner, KS (US)

(73) Assignee: Castle Creations, Inc., Olathe, KS (US)

( * ) Notice: Subject to any disclaimer, the term of this patent is extended or adjusted under 35 U.S.C. 154(b) by 831 days.

(21) Appl. No.: 11/741,342

(22) Filed: Apr. 27, 2007

(51) Int. Cl.
*G06F 19/00* (2006.01)

(52) U.S. Cl. ..... 701/36; 701/33

(58) Field of Classification Search ..... 701/1, 701/29–30, 33, 36
See application file for complete search history.

(56) References Cited

U.S. PATENT DOCUMENTS 7,391,320 B1 * 6/2008 Beard et al. ..... 340/539.1
7,395,126 B2 * 7/2008 Decker ..... 700/65

* cited by examiner

*Primary Examiner*—Yonel Beaulieu
(74) *Attorney, Agent, or Firm*—Shook, Hardy & Bacon, L.L.P.

(57) ABSTRACT

Systems and methods are provided for processing control inputs at a receiver for one or more servos coupled to a vehicle. A signal containing a plurality of control inputs generated in response to an activation of at least one control element on a transmitter is received at a receiver mounted on a vehicle. The plurality of control inputs is mapped to a vehicle-specific set of servo control signals at the receiver using operations such as reversing, shifting, scaling, delaying, and mixing.

20 Claims, 5 Drawing Sheets

MAPPING CONTROL INPUTS TO VEHICLE-SPECIFIC CONTROL OUTPUTS AT A RECEIVER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

Historically, receivers coupled to a remote controlled vehicle simply receive remote control signals from a transmitter and output the remote control signals directly to one or more servos coupled to the remote controlled vehicle. More sophisticated receivers are able to filter the remote control signals, for example, in order to remove glitches that are typically caused by weak signal strength. Some of those receivers are also equipped with a type of fail-safe feature that typically generates default control signals for adjusting to a pre-selected motion and/or speed when some or all of the remote control signals are no longer intelligible. In general, however, most intelligent and complex operations involved in generating remote control signals for remote controlled vehicles are performed at transmitters.

Currently available transmitters for remote controlled vehicles range from very basic and inexpensive transmitters to very complex and expensive transmitters. Basic transmitters simply generate control inputs based on one or more control elements (e.g., dial knob, control stick), generate remote control signals containing the control inputs, and transmit the remote control signals to a receiver. More sophisticated transmitters typically have multiple vehicle (model) memories to store several sets of control input setup information for multiple vehicles. Users of the sophisticated transmitters, however, sometimes switch the transmitters to an incorrect vehicle (model) memory, thereby causing serious damage or even a total destruction of a remote controlled vehicle that they attempt to control. For instance, a user may crash a model helicopter if the user attempts to fly it using a transmitter that is incorrectly switched to a vehicle memory for a model speed boat. Users also often have difficulty programming the vehicle memories with different setup information through a typically small display area and/or keypad on the transmitters.

SUMMARY

The present invention is defined by the claims below, not this summary. Embodiments of the present invention provide a system, method, and product for, among other things, mapping control inputs from a transmitter to vehicle-specific servo control signals at a receiver. The present invention has several practical applications in the technical arts, including allowing users to control many different types of vehicles from a simple and inexpensive transmitter and providing a more user-friendly programming interface to configure a receiver for mapping control inputs to servo control signals.

In a first aspect, an exemplary embodiment of the present invention relates to a method for processing control inputs at a receiver for one or more servos coupled to a vehicle. A signal containing a plurality of control inputs from a transmitter is received at a receiver mounted on a vehicle. The plurality of control inputs is mapped to a vehicle-specific set of servo signals at the receiver.

In another aspect, an exemplary embodiment of the present invention relates to a system for processing control inputs at a receiver for one or more servos coupled to a vehicle. The system includes a transmitter and a receiver. The transmitter is configured to transmit a signal containing a plurality of control inputs, wherein the plurality of control inputs is generated based on at least one control element on the transmitter. The receiver mounted on a vehicle having one or more servos is configured to map the control inputs to a set of servo control signals specific to the vehicle, wherein the receiver receives and recovers the control inputs.

In yet another aspect, an exemplary embodiment of the present invention relates to a receiver for processing control inputs for one or more servos coupled to a vehicle. The receiver includes a communication interface and a control module. The communication interface is configured to receive an input signal containing a plurality of control inputs from a transmitter. The control module is configured to map the plurality of control inputs to a vehicle-specific set of servo control signals.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
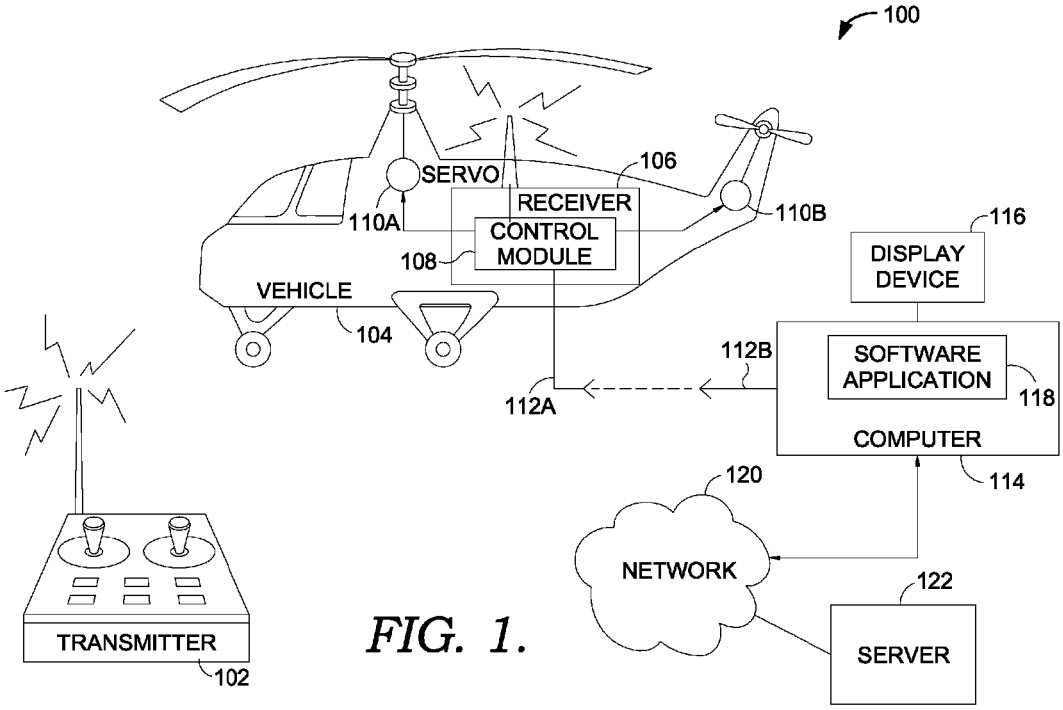
FIG. 1 depicts an exemplary system environment suitable for use in implementing embodiments of the present invention.

Embodiments of the present invention provide systems and methods for mapping control inputs generated at a transmitter to servo control signals by mixing, reversing, shifting, scaling, and delaying the control inputs at a receiver.

While the type of vehicle described in detail herein is a model vehicle, one skilled in the art will appreciate that the present invention may be implemented with other types of vehicles equipped with a receiver and remotely controllable servos. Likewise, one skilled in the art will appreciate that while a personal computer is described herein as an example for programming a receiver, the present invention may be implemented with other types of computing devices that can communicate with a receiver and run a software application to configure the receiver.

Although the type of network and server described in detail herein are the Internet and a web server for downloading software for the receiver, one skilled in the art will appreciate that the present invention may be implemented with other types of networks and servers.

Throughout the description of the present invention, several acronyms and shorthand notations are used to aid the understanding of certain concepts pertaining to the associated system and services. These acronyms and shorthand notations are solely intended for the purpose of providing an easy methodology of communicating the ideas expressed herein and are in no way meant to limit the scope of the present invention. The following is a list of these acronyms:

| | |
|---|---|
| AM | Amplitude Modulation |
| API | Application Programming Interface |
| CD-ROM | Compact Disc-Read Only Memory |
| DAC | Digital-to-Analog Converter |
| DVD | Digital Versatile Disc |
| EEPROM | Electrically Erasable Programmable Read Only Memory |
| ESC | Electronic Speed Control |
| FM | Frequency Modulation |
| FSK | Frequency-Shift Keying Modulation |
| IEEE | Institute of Electrical and Electronics Engineers |
| PDA | Personal Digital Assistant |
| PM | Phase Modulation |
| PPM | Pulse Period Modulation |
| PSK | Phase-Shift Keying Modulation |
| PCM | Pulse Code Modulation |
| RAM | Random Access Memory |
| ROM | Read Only Memory |
| USB | Universal Serial Bus |

As one skilled in the art will appreciate, embodiments of the present invention may be embodied as, among other things: a method, system, or computer-readable medium. Accordingly, the embodiments may take the form of a hardware embodiment, a software embodiment, or an embodiment combining software and hardware. In one embodiment, the present invention takes the form of one or more computer-readable media that include computer-useable instructions embodied thereon.

Computer-readable media include both volatile and nonvolatile media, removable and nonremovable media, and contemplate media readable by a database, a computer, and various other computing devices. By way of example, and not limitation, computer-readable media comprise computer-storage media and communications media.

Computer-storage media, or machine-readable media, include media implemented in any method or technology for storing information. Examples of stored information include computer-useable instructions, data structures, program modules, and other data representations. Computer-storage media include, but are not limited to RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These memory components can store data momentarily, temporarily, or permanently.

Communications media typically store computer-useable instructions—including data structures and program modules—in a modulated data signal. The term "modulated data signal" refers to a propagated signal that has one or more of its characteristics set or changed to encode information in the signal. An exemplary modulated data signal includes a carrier wave or other transport mechanism. Communications media include any information-delivery media. By way of example but not limitation, communications media include wired media, such as a wired network or direct-wired connection, and wireless media such as acoustic, infrared, radio, microwave, spread-spectrum, and other wireless media technologies. Combinations of the above are included within the scope of computer-readable media.

The subject matter of the present invention is described with specificity herein to meet statutory requirements. However, the description itself is not intended to limit the scope of this patent. Rather, the inventors have contemplated that the claimed subject matter might also be embodied in other ways, to include steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed.

Turning now to FIG. 1, an exemplary system environment suitable for use in implementing embodiments of the present invention is provided and referenced generally by the numeral 100. FIG. 1 is illustrative in nature and should not be construed as limiting the present invention, as with all of the figures herein. It should be understood that this and other arrangements described herein are set forth only as examples. Other arrangements and elements (e.g., machines, interfaces, functions, orders, and groupings of functions, etc.) can be used in addition to or instead of those shown, and some elements may be omitted altogether. Further, many of the elements described herein are functional entities that may be implemented with other components and in any suitable combination and location. Various functions described herein as being performed by one or more entities may be carried out by hardware, firmware, and/or software. For instance, some functions may be carried out by a processor executing instructions stored in memory.

As shown in FIG. 1, system environment 100 may include, among other components, a transmitter 102, a vehicle 104, a receiver 106, a control module 108, a set of servos 110A, 110B, a set of communication interfaces 112A, 112B, a computer 114, a display device 116, a software application 118, a network 120, and a server 122.

The transmitter 102 may be any of a wide variety of digital or analog transmitters, and more specifically radio signal transmitters, that are known in the art. For example, the transmitter 102 may be a simple, inexpensive transmitter, or it may be a more sophisticated transmitter having multiple vehicle memories for controlling multiple vehicles. The transmitter 102 also typically has a power source that provides power for transmission of signals. The transmitter 102 may support a varying number of channels for transmitting control inputs.

The transmitter 102 typically has a set of control elements comprising one or more of a control stick, a trigger, a switch, and a dial knob. In general, the transmitter 102 generates control inputs based on one or more control elements thereon, modulates the control inputs, and transmits the modulated control inputs to the receiver 106. The transmitter 102 may use any of the modulation techniques known in the art. Typically, either pulse code modulation (PCM) or pulse period modulation (PPM) is employed for remote controlled model vehicles.

The vehicle 104 may be any vehicle having the receiver 106 and the servos 110A, 110B coupled thereto. Although remote controlled model vehicles are used to illustrate an exemplary system environment and methods, the vehicle 104 may be any vehicle that is equipped to receive control inputs and operate in accordance with the control inputs. For instance, the vehicle 104 may be an unmanned military vehicle, such as a reconnaissance/bomber drone, a satellite floating above the earth, a space craft, or a robot. The vehicle 104 may be a model vehicle, such as a car, a truck, a helicopter, a sailboat, a motor boat, a ship, an airplane, a submarine, etc.

The receiver 106 may be any of a wide variety of digital or analog receivers that are known in the art. The receiver 106 is typically mounted on the vehicle 104. In general, the receiver 106 receives a signal containing control inputs from the transmitter 102, recovers the control inputs, maps the control inputs to a vehicle-specific set of servo control signals, and communicates the vehicle-specific servo control signals to the servos 110A, 110B. The receiver 106 may use any of the demodulation techniques known in the art.

The receiver 106 may include the control module 108 that may be configured to map the control inputs to the vehicle-specific servo control signals. The receiver 106 may also include the communication interface 112A that can be used to connect to the computer 114. The receiver 106 may also have a set of servo control signal output ports that is connected to the servos 110A, 110B.

The control module 108 is, in general, communicatively coupled to the receiver 106. Alternatively, the control module 108 may be integrated with the receiver 106. The control module 108 may comprise a special circuitry running a specially designed firmware. It may comprise a general signal processing circuitry running a proprietary software module. It may also comprise a software module designed to perform a set of complex mathematical operations on data passed from the receiver 106.

Typically, the control module 108 receives control inputs from the receiver 106 and maps the control inputs to a set of vehicle-specific servo control signals. The control module 108 may output the vehicle-specific servo control signals directly to the servo control signal output ports. It may also pass the vehicle-specific servo control signals to the receiver 106 for transmission thereof to the servos 110A, 110B. The control module 108 may have a communication interface, such as the communication interface 112A, to communicate with the computer 114. The control module 108 may also communicate with the computer 114 through the communication interface 112A of the receiver 106.

Typically, the servos 110A, 110B are electric motors that use electrical energy to create mechanical force. In general, the servos 110A, 110B provide angular outputs although linear outputs are not uncommon. For example, the servos 110A, 110B may be connected to a reduction gearbox to drive various mechanical parts. The servos 110A, 110B are driven until a position and/or speed commanded by servo control signals generated at the receiver 106 or the control module 108 are attained. Even though only two servos are shown in FIG. 1, the vehicle 104 may have any number of servos. For example, a sophisticated unmanned military drone may have many tens of servos, and a less sophisticated model vehicle may only have one or two servos.

Applications for the servos 110A, 110B abound. By way of example and not limitation, the servos 110A, 110B may be used to control main rotors, cyclic controls (pitch and roll), and tail rotors (yaw) of model helicopters. The servos 110A, 110B may be used to control ailerons, elevators, motor speed, rudder, landing gears, and flaps of model airplanes. They may be used to control motor speed and steering gear or rudder of a land vehicle or a boat, respectively.

Typically, the communication interfaces 112A, 112B are USB interfaces. However, they may also be serial interfaces, parallel interfaces, IEEE 1394 interfaces, and the like. In general, the communication interfaces 112A, 112B are located on the receiver 106 and the computing device 114, respectively. Alternatively, however, the communication interface 112A may be located on the control module 108.

Typically, the computer 114 is a general purpose computer (e.g., personal computer) running a common operating system (e.g., Microsoft® Windows®, Mac OS®, or a Linux® operating system) that provides a graphical user interface for a user-friendly environment and a network interface (e.g., TCP/IP interface) for communication through a network (e.g., the Internet). In general, no distinction is made herein between such categories as "workstation," "server," or "laptop." The computer 114 may also support an output device, such as the display device 116, and a communication interface, such as the communication interface 112B.

The computer 114 may be, however, other types of computing devices that can communicate with the receiver 106 or the control module 108, support the display device 116 and a network interface, and run the software application 118. Such other types of computing devices may include a PDA, a SmartPhone, a wireless mobile phone, and any other device having a bus that directly or indirectly couples memory, one or more processors, input/output ports, input/output components, and a power supply.

The computer 114 may run the software application 118, through which a user can program or configure the receiver 106 or the control module 108. The display device 116 may be communicatively connected to the computer 114. Alternatively, the display device 116 may be attached to the computer 114 as in a laptop computer.

The computer 114 may also connect to the network 120 (e.g., the Internet) and download an update module for the software application 118 or an upgraded version thereof from the server 122 (e.g., web server) on the network 120. Typically, the downloaded update module for the software application 118 or the upgrade version thereof is installed directly on the receiver 106 or the control module 108 from the computer 114. The upgrade version of and/or updated module for the software application 118 may be also installed through the software application 118.

In general, the software application 118 is a proprietary software program that establishes communication with the receiver 106 or the control module 108 through the communications interfaces 112A, 112B and provides a user-friendly interface (e.g., a graphical user interface) for programming the receiver 106 or the control module 108. For example, a dialog window can be provided for users to program specific mapping equations and/or adjustment values for scaling or shifting operations.

The software application 118 may also take the form of a class or function library (e.g., a dynamic link library, a Java package) or a set of application programming interfaces (APIs) (e.g., Unix system call library). Users can write a program or a script that links to the function library and calls the functions provided by the function library to program the receiver 106 or the control module 108.

Figure 2:
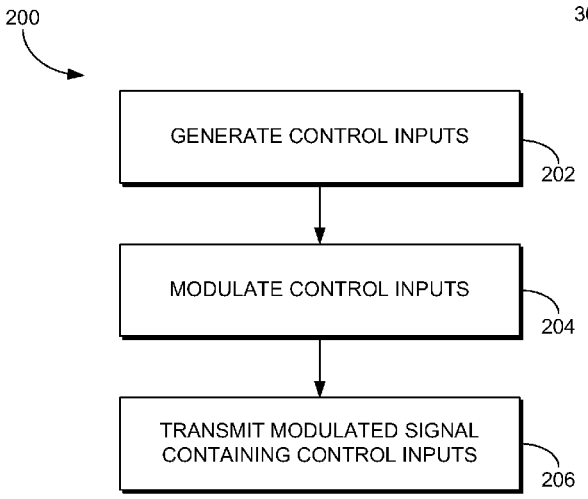
FIG. 2 is a flow diagram showing an exemplary method for generating a signal containing control inputs in accordance with an embodiment of the present invention.

Turning to FIG. 2, a flow diagram is used to show an exemplary method 200 for generating a signal containing control inputs. At block 202, control inputs are generated at the transmitter 102. In some embodiments, the control inputs are generated based on at least one control element on the transmitter 102.

At block 204, a carrier signal is modulated with the control inputs at the transmitter 102 for transmission. A variety of digital and analog modulation techniques such as amplitude modulation (AM), frequency modulation (FM), phase modulation (PM), phase-shift keying modulation (PSK), frequency-shift keying modulation (FSK), pulse code modulation (PCM), pulse period modulation (PPM), spread spectrum, to name a few, and the like are known in the art, and any of them or any combination may be employed to modulate the signal carrying the control inputs. At block 206, the modulated signal containing the control inputs is transmitted to the receiver 106 from the transmitter 102.

An example is provided below to illustrate the method 200 above. Suppose a user flying a model airplane wishes to increase the cruising speed of the model. The user pushes the throttle control stick forward. The generated set of control inputs now has a different value for the channel associated with the throttle control stick. The transmitter then modulates a carrier signal with the set of control inputs and transmits the signal to the model airplane.

Figure 3:
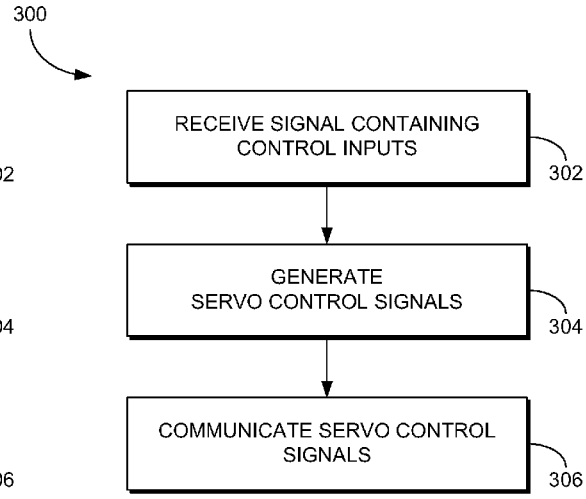
FIG. 3 is a flow diagram showing an exemplary method for processing control inputs at a receiver in accordance with an embodiment of the present invention.

Turning to FIG. 3, a flow diagram is used to show an exemplary method 300 for processing control inputs at a receiver. At block 302, a signal containing control inputs is received at the receiver 106. At block 304, a vehicle-specific set of servo control signals is generated. In some embodiments, the receiver 106 maps the input controls to the vehicle-specific set of servo control signals. In some other embodiments, the control module 108 coupled to the receiver 106 is entrusted with the task.

At block 306, the vehicle-specific servo control signals are communicated to the servos 110A, 110B. In some embodiments, the receiver 106 communicates the vehicle-specific servo control signals through a set of corresponding servo control output ports. In some embodiments, in which the control module 108 maps the control inputs to the vehicle-specific set of servo control signals, the control module 108 directly transmits the vehicle-specific servo control signals to the servos 110A, 110B.

Continuing from the model airplane example above, a receiver mounted on the model airplane receives the carrier signal containing the set of control inputs and maps the set of control inputs to a set of servo control signals specific to the model airplane. The receiver then communicates the servo control signals to the servos in the model airplane. The electronic speed control (ESC) that controls the propeller of the model airplane receives the control input generated by the throttle control stick on the transmitter and increases the rate at which it turns the propeller. The values that control the other control servos, such as elevator and rudder, have the same setting as before the change and so the airplane maintains the same attitude. The model airplane maintains the course and the new speed until the user further changes the control elements on the transmitter to change the course and/or the speed of the model airplane.

Figure 4:
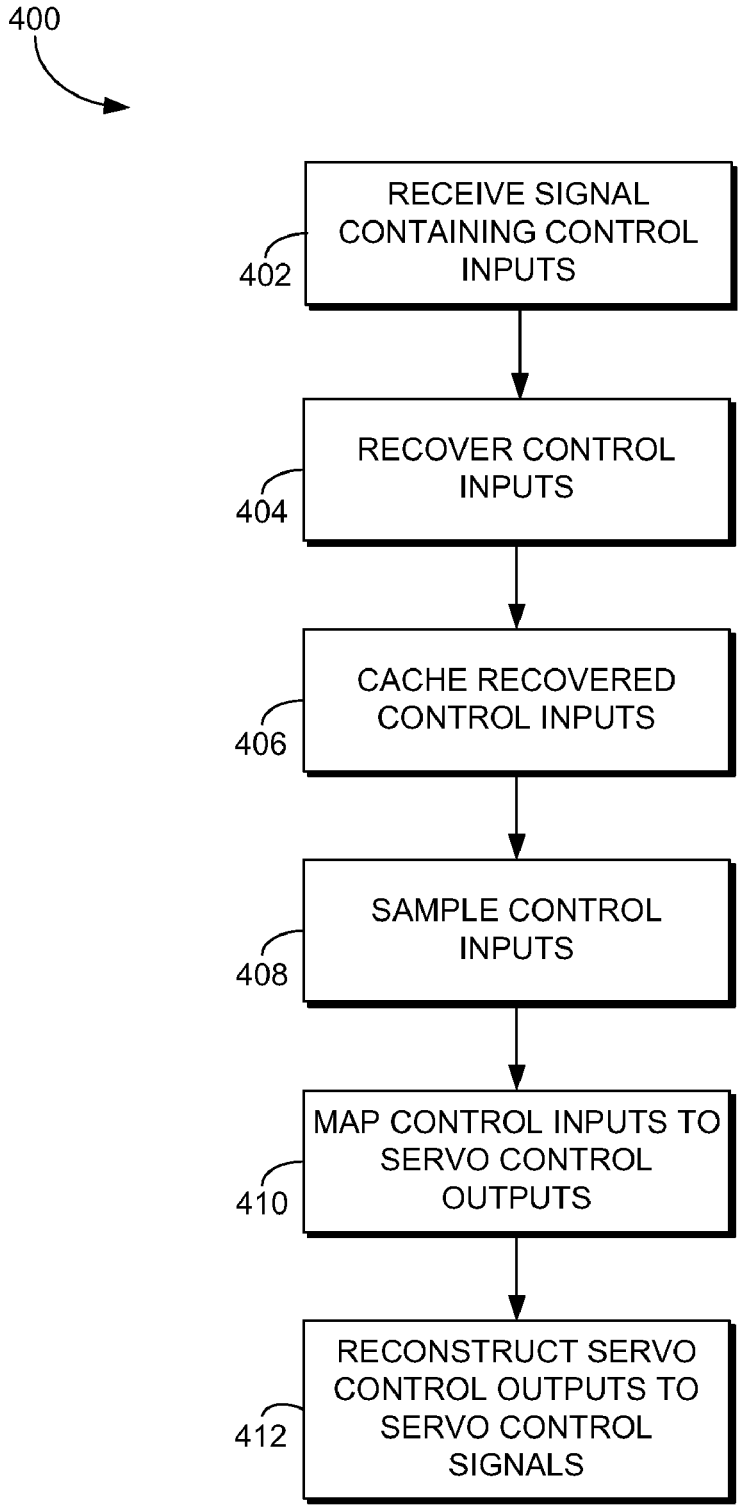
FIG. 4 is a flow diagram showing an exemplary method for generating servo control signals in accordance with an embodiment of the present invention.

Turning to FIG. 4, a flow diagram is used to show an exemplary method 400 for generating servo control signals. At block 402, the receiver 106 receives a signal containing control inputs from the transmitter 102. At block 404, the receiver 106 recovers the control inputs. At block 406, the recovered control inputs are cached. In some embodiments, the receiver 106 caches the control inputs in a buffer memory. In some other embodiments, the control module 108 caches the control inputs in a cache memory. In some embodiments, the control inputs are analog pulses; in which case, the receiver 106 may need to sample the analog control inputs to convert them to digital pulses at block 408. If the control inputs are not analog pulses, however, block 408 may not be utilized.

At block 410, the control inputs are mapped to a vehicle-specific set of servo control outputs. In some embodiments, the receiver 106 maps the control inputs to the servo control outputs. In some other embodiments, the control module 108 performs the task of mapping the control inputs to the servo control outputs. Typically, mapping involves shifting, reversing, delaying, and/or scaling one or more control inputs or mixing two or more of the control inputs to generate one or more servo control outputs. Also, two or more control inputs that are shifted, reversed, scaled, and/or delayed may be mixed to generate one or more servo control outputs. Methods for reversing, scaling, shifting, delaying, and mixing control inputs are further illustrated and defined here and also below in conjunction with FIG. 5.

Still with regard to FIG. 4, at 410 the control inputs are mapped to control outputs. In a common servo control example values are contained in a repeating communication frame of 8 parameters that nominally range from 1 to 2 milliseconds (ms), having a frame repetition rate of 50 Hertz (Hz). Further examples and definitions of terms will be made with respect to these conventional intervals. The use of the illustrated mapping systems and methods to map other servo control values and to employ other communication methods are anticipated and within the scope of application intended. For example, other embodiments make use of a repeating frame each having 2 to 14 control inputs. Still other embodiments have more than 14 control inputs per frame. Some embodiments have pulse widths that vary between 0.8 and 2.2 ms. Some embodiments have a frame repetition rate of 25 Hz. Some embodiments have a frame repetition rate of 75 Hz.

There are defined herein some variables that are helpful for illustrating exemplary mapping methods by way of equations that could be used in 410 of FIG. 4. Exemplary control input values within a frame may be denoted in1, in2, in3, in4, in5, in6, in7, and in8, respectively. These control inputs may be first converted into a number of internal values within a frame that may be denoted inter1, inter2, inter3, inter4, inter5, inter6, inter7, and inter8. The output control values within a frame may be denoted out1, out2, out3, out4, out5, out6, out7 and out8. Output control values may be defined in terms of either past or present internal values or past or present input control values, or past output control values so that mapping operations may be chained or combined. A number of static parameters that could be used within a mapping are defined and indicated below by all capital letters. Exemplary static parameters include OFFSET, OFFSET1, SCALE1, SCALE2, VECTORSCALE, MAX1, MAX2, MIN1, MIN2, DELAY1, DELAY2, and MAXCHANGE1. In light of these definitions, several mappings are illustrated below.

An offset mapping, also known as "Trim" or "Sub Trim" in the art, is the mapping of an input to an output through the addition or subtraction of a static parameter OFFSET. It may be implemented simply by the following equation:

$$out1=in1+OFFSET1$$

Reverse is a mapping that translates small values into large values and large values into small values. A typical equation to implement the reverse mapping for channel 2 is as follows:

$$out2=1.5-in2$$

Scale, also known in the art as End Point Adjust (EPA), is a mapping that translates an input into a scaled version of itself for output. A typical equation to implement scaling for channel 1 is as follows:

$$out1=SCALE1*in1$$

Vector scale, also known in the art as "Expo Curve," is a mapping of a control input through an array of scalar factors that are defined by the user, so that the factor used varies with the input value. This may be expressed in equation form as follows:

$$Out1=int*VECTORSCALE(in1)$$

In some embodiments a user defines a curve by a series of ordered pairs of (inputvalue, outputvalue). Some of these embodiments interpolate to produce an interpolated output value that is between the output values corresponding to the two nearest input values for a given sample.

Range limiting is a mapping that imposes a maximum or minimum value, or both on an input. Range limiting may for example be a simple minimum or a simple maximum implemented for channel 2 by the following equations:

$$inter2=max(MIN2,in2)$$

$$out2=min(MAX2,inter2)$$

Mixing is a combination of two or more scaled input values to form a composite signal from the input values. The following equation shows how an output channel 1 may be formed from a mix of input channels 1 and 2.

$$out1=SCALE1*in1+SCALE2*in2$$

The scale values SCALE1 and SCALE2 may for example be factors between −1 and 1. Mixes may be defined to combine any two channels through scaling factors. Any number of input channels may be mixed together to form a composite output. As an example of how mixing may be used to advantage in an application consider Elevon mixing. Elevon control combines the function of an elevator for pitch control with an aileron for roll control, hence the name. If the roll channel is channel 1, and the pitch channel is channel 2 and the speed channel is channel 3, then an Elevon mix may be represented by the following equations:

$$out1=0.5*in1+0.5*in2$$

$$out2=-0.5*in1+0.5*in2$$

$$out3=in3$$

Here out1 produces the Right Elevon control, and out2 produces the Left Elevon control. The speed input is simply tied to an electronic speed control (ESC). In this example, the scale factors are chosen to be 0.5, but the user has freedom to define these as desired. With this mix only two servos control both pitch and roll. By looking at the scaling factors, we see that in this mix the pitch input in2 affects both servos equally while the roll input in1 affects the right servo in the opposite way to the left servo.

Response rate is a mapping that limits the maximum change in output that may be applied to a control output. To apply this mapping, the prior value for an output is stored. This mapping may be applied by the set of equations:

$$out1(i)=min(in1(i),MAXCHANGE1+out1(i-1)),\ \text{for a non-negative change}$$

$$out1(i)=max(in1(i),out1(i-1)-MAXCHANGE1)),\ \text{for a negative change.}$$

Where out1(i) represents the output value for the first output of the ith frame, and in1(i) represents the input for channel 1 in the ith frame, and out1(i−1) represents the output value for first output in the (i−1)st frame. This mapping may be used to advantage, for example, to slow the speed of deployment of landing gear, and thus to decrease mechanical stress on hardware.

Delay is a mapping that applies an input to create a corresponding output after a programmable delay period. For binary control signals this could be implemented by a counter. For analog control signals, this function may be implemented by a programmable buffer. The programmable delay may be used to advantage when the two servos are controlled that open bay doors or deploy landing gear. Rather than have these two functions independently controlled, the deployment of landing gear could be tied to the control that opens the bay doors, but after a suitable delay.

In some embodiments, the servos 110A, 110B require analog control signals. In such embodiments, the servo control signals are reconstructed from the servo control outputs at block 412. For instance, a digital-to-analog converter (DAC) may be used to perform the task of reconstruction. Block 412, however, may not be utilized if the servos 110A, 110B do not require analog control inputs. As those skilled in the art will appreciate, the servo control may be a mix of analog and digital. The control signal may be a PWM signal with rising edges repeating at approximately 50 Hz. The high time represents the desired position/speed. Typically the minimum of the control is 1 ms and the maximum is 2 ms.

Figure 5:
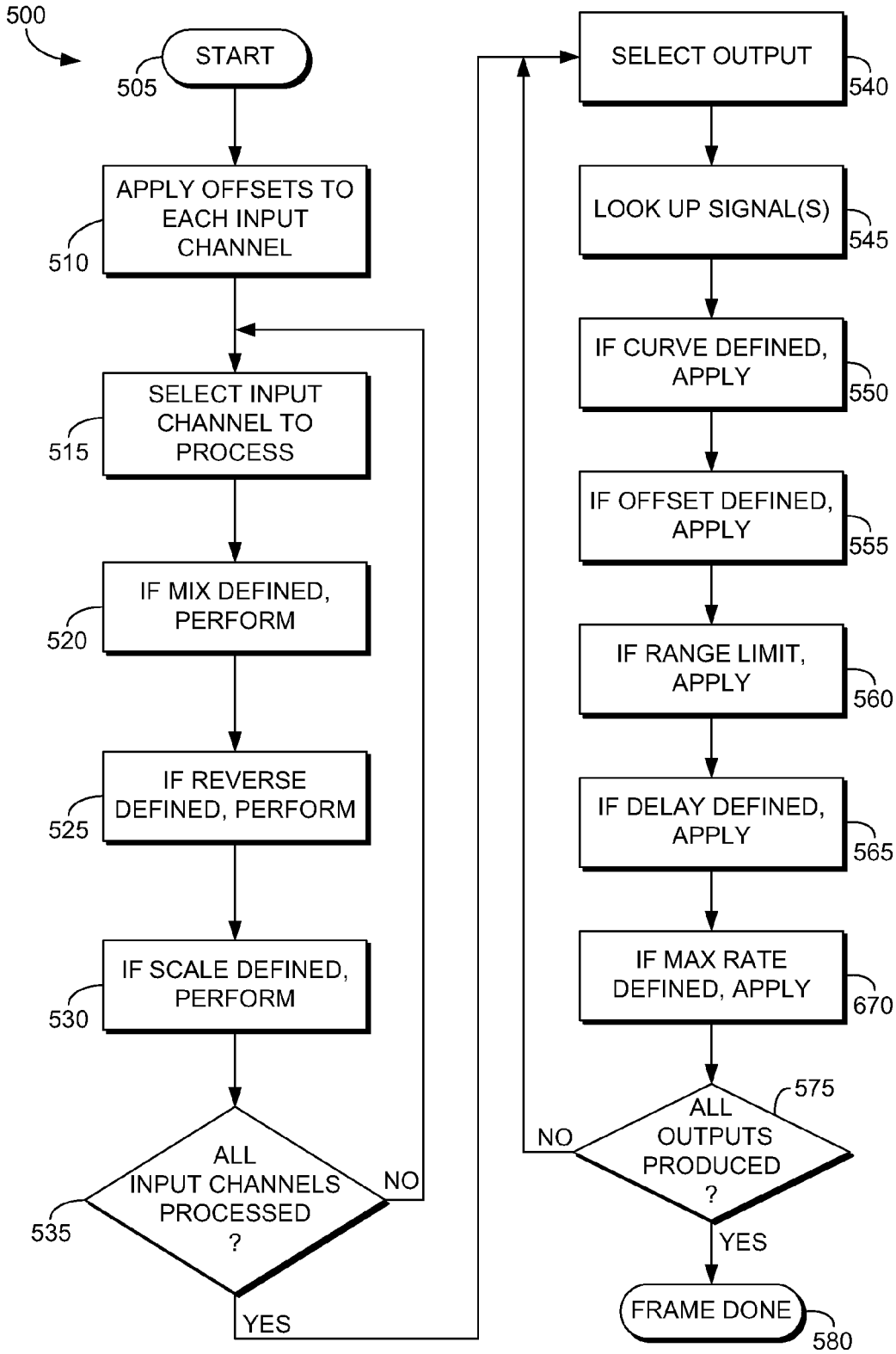
FIG. 5 is a flow diagram showing an exemplary method of mapping a frame of control inputs to a frame of control outputs.

Turning now to FIG. 5, there is depicted therein a flow diagram of a particular embodiment of a method 500 for converting a frame of inputs to a frame of outputs. This conversion process is one embodiment of operations performed at 410 of FIG. 4. The method begins at 505 when a new frame of input control values is at least partially received. At 510 an offset is applied to each channel which has had an offset defined for it. A single input channel is selected for processing, and a number of mappings are performed to this input channel in 515. The method determines at 520 whether or not a mix has been defined for this particular channel, and if so the mix is performed to produce an internal signal. At 525, a check is made to see if a reverse has been defined for the present input, and if so it is applied to the input to produce another internal signal. If there is a scale defined for the present channel it is applied at 530. At 535 it is determined whether or not all of the input channels have been processed as required by the defined mapping. If input channels still remain to be processed then the method returns to 515 to select an additional input channel. Otherwise, all input channels have been processed, and so the method proceeds to 540, where an output is selected for processing. At 545 the signals necessary to produce the selected out are looked up. The signals that are looked up may be either inputs, internal signals, or prior outputs. At 550 an Expo Curve, or vector scale, is applied if this operation is indicated for the selected output. An output offset is applied at 555 if defined. At 560 range limits are applied. A delay is applied at 565 if the present output has this operation enabled. At 570 a maximum response rate is applied if one is defined for the selected output. It is determined at 575 whether or not all of the output channels have been produced as required by the defined mapping. If output channels still remain to be produced then the method returns to 540 to select an additional output channel. Otherwise, all input channels have been produced, and so the method of processing the present frame terminates at 580.

An example is provided below to illustrate how servo control signals are generated in response to control inputs generated at a transmitter. Suppose a user has a basic analog transmitter that supports transmission channels of only four control inputs, but has a model airplane that has eight servos to control the main propeller, one rudder, two ailerons, two elevators, and two landing gears. The user can fly the model airplane by programming a control module coupled to the receiver mounted on the model airplane to map the four control inputs to eight servo control signals. For instance, the user can map the roll input to the two ailerons (reversing one will likely be necessary), the pitch input to the two elevators, the roll input to the rudder, and the throttle input to the ESC controlling the main propeller. Now, to control the landing gear, the user can map a delay signal such that 20 seconds after throttle-up the landing gear will retract, sufficiently after takeoff, and 2 seconds after throttle-down the landing gear will engage in preparation for landing. Although this is not the best setup for a plane with landing gear, it simplifies the procedure and allows a user with an inexpensive radio to completely control his/her aircraft.

Figure 6:
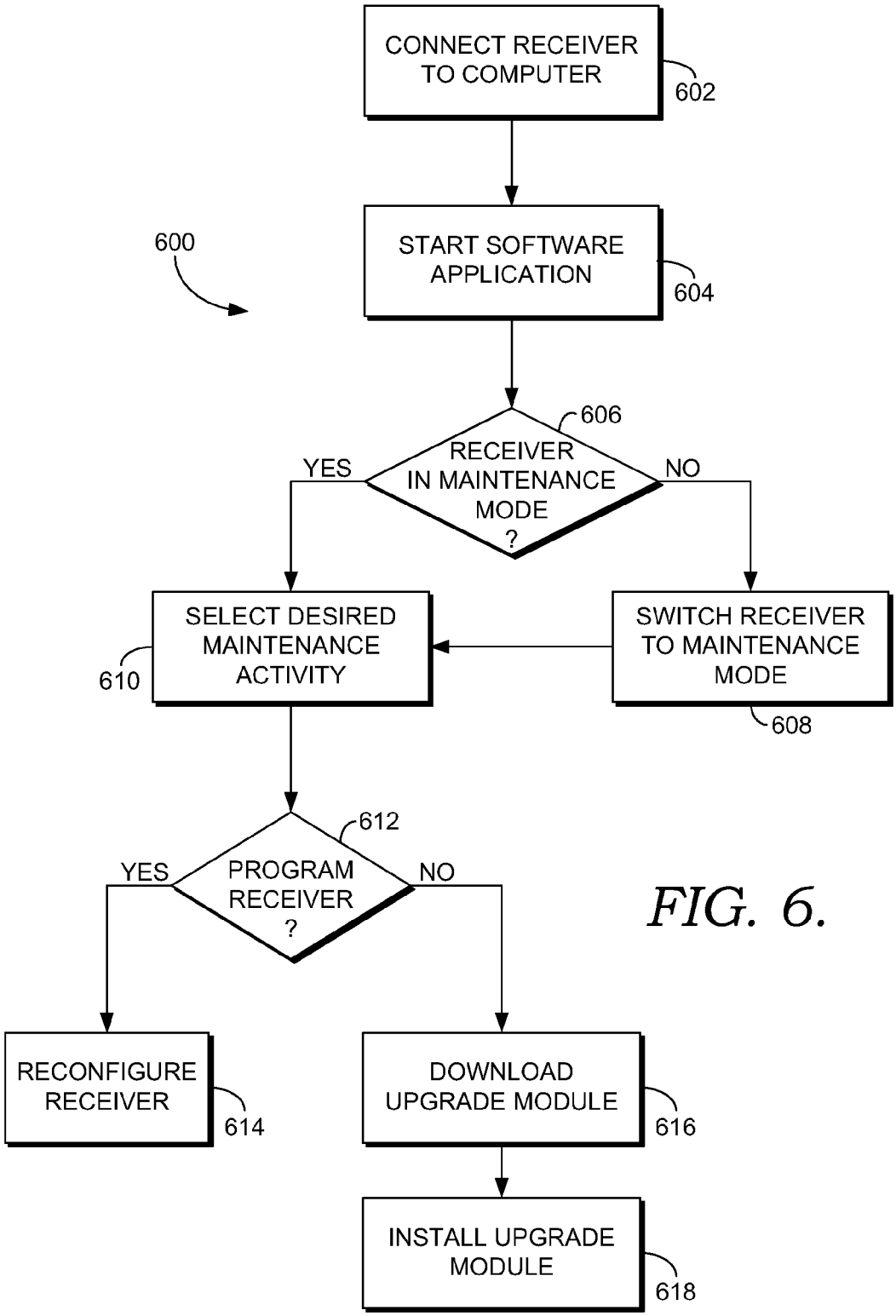
FIG. 6 is a flow diagram showing an exemplary method for programming a receiver in accordance with an embodiment of the present invention.

Turning to FIG. 6, a flow diagram is used to show an exemplary method 600 for programming a receiver. At block 602, the receiver 106 is connected to the computer 114 through the communications interfaces 112A, 112B. In some embodiments, the computer 114 is connected to the receiver 106 through a USB cable. In some other embodiments, they are connected through a serial or parallel cable. At block 604, the software application 118 is started. Typically, the receiver 106 is automatically switched to a maintenance mode when the receiver 106 is connected to the computer 114 at block 602. In some embodiments, however, the receiver 106 remains in an operational mode until it is switched to the maintenance mode. In such embodiments, it is determined whether the receiver 106 is in the maintenance mode at block 606. If it is determined that the receiver 106 is not switched to the maintenance mode yet, the receiver 106 is switched to the maintenance mode at block 608. In some embodiments, the software application 118 detects that the receiver 106 is not in a maintenance mode and switches it to the maintenance mode.

At block 610, a desired maintenance activity is selected. In some embodiments, a user is given a menu list of available maintenance activities, such as configuration of the receiver 106 or the control module 108 and installation of an update software module (e.g., update patch or service package) for the software or firmware run by the receiver 106 and/or the control module 108 and/or upgrade version thereof.

At block 612, it is determined whether the task of programming the receiver 106 is selected. If a programming task is selected, the receiver 106 or the control module 108 is programmed or reconfigured at block 614. For instance, a user can change current settings for mapping control inputs to vehicle-specific servo control signals through a dialog window.

If, however, it is determined that the task of installing an update module for and/or upgrade version of the software or firmware run by the receiver 106 is selected at block 612, such update module for and/or upgrade version of the software or firmware is downloaded first, if not downloaded already, at block 616. If the software has been downloaded already, block 616 may not be utilized. At block 618, the downloaded software is installed on the receiver 106 or the control module 108.

An example is provided below to illustrate the method 600 above. Returning to the model airplane example above, after landing the model airplane a number of times, the user realizes that the landing gears deploy too late. The last time the user landed the model airplane, the plane almost hit the ground before the landing gears were completely deployed. The user connects the receiver mounted on the model airplane to her laptop using a USB cable. The user has previously installed software application that provides a graphical user interface for programming the receiver on the laptop using a CD-ROM that came with the receiver. The user starts the application software. The application software quickly establishes communication with the receiver and presents a menu listing activities to choose from. The user selects "Configure the Receiver" option from the menu, and the application software brings up a dialog window displaying the current settings of the model airplane. The user changes the delay factor related to deploying the landing gears such that the delay for deploying the landing gears will be shorter.

As can be seen, the present invention and its equivalents are well-adapted to provide a new and useful method for: (1) mapping control inputs from a transmitter to a set of servo control signals at a receiver, thereby allowing users to control multiple types of vehicles from a simple, inexpensive transmitter, and (2) providing a user-friendly programming interface to program a receiver for mapping control inputs to servo control signals for different vehicles.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out, or carried out at all in some instances, in the specific order described.

The invention claimed is:

1. A method for processing control inputs at a receiver for one or more servos coupled to a vehicle, the method comprising:

receiving, at a receiver mounted on a vehicle, a signal containing a plurality of control inputs from a transmitter; and mapping at the receiver the plurality of control inputs to a vehicle-specific set of servo control signals.

2. The method of claim 1, wherein the plurality of control inputs is generated in response to an activation of at least one control element on the transmitter.

3. The method of claim 2, wherein the control elements comprise one or more of a control stick, a trigger, a switch, and a dial knob.

4. The method of claim 1, wherein the vehicle-specific set of servo control signals is generated at a control module running software on the receiver.

5. The method of claim 4, wherein the control module operates in an operational mode.

6. The method of claim 4, wherein a user can download upgrade modules for the software from a server through a network.

7. The method of claim 6, wherein the network comprises the Internet and the server comprises a web server supporting a web site.

8. The method of claim 4, wherein the software can be installed or programmed by connecting the control module in a maintenance mode to a computer running an application using a user interface provided by the application.

9. The method of claim 8, wherein the control module and the computer communicates using USB protocol.

10. The method of claim 8, wherein the user interface comprises a graphical user interface.

11. The method of claim 1, wherein mapping the plurality of control inputs comprises one or more of:

reversing at least one of the plurality of control inputs;

shifting at least one of the plurality of control inputs;

scaling at least one of the plurality of control inputs;

delaying at least one of the plurality of control inputs; and mixing at least two of the plurality of control inputs.

12. The method of claim 1, further comprising demodulating the signal at the receiver.

13. The method of claim 1, further comprising communicating the vehicle-specific set of servo control signals to a corresponding set of servos.

14. The method of claim 1, further comprising converting the vehicle-specific set of servo control signals to an analog equivalent thereof.

15. The method of claim 1, further comprising caching the plurality of control inputs at the receiver.

16. The method of claim 1, wherein the vehicle comprises a model vehicle and the signal comprises a radio signal.

17. One or more computer-readable media having computer-usable instructions embodied thereon for performing the method recited in claim 1.

18. A system for processing control inputs at a receiver for one or more servos coupled to a vehicle, the system comprising:

a transmitter configured to transmit a signal containing a plurality of control inputs, wherein the plurality of control inputs are generated in response to an activation of at least one control element on the transmitter; and a receiver mounted on a vehicle having one or more servos and configured to map the control inputs to a set of servo control signals specific to the vehicle, wherein the receiver receives and recovers the control inputs.

19. A receiver for processing control inputs for one or more servos coupled to a vehicle, the receiver comprising:

a communication interface configured to receive an input signal containing a plurality of control inputs from a transmitter; and a control module configured to map the plurality of control inputs to a vehicle-specific set of servo control signals.

20. The receiver of claim 19, wherein the control module is further configured to communicate with a computer running a software application for receiving updated setup information.

* * * * *